US006522761B1

(12) United States Patent
Ruffa

(10) Patent No.: US 6,522,761 B1
(45) Date of Patent: Feb. 18, 2003

(54) DIRECTIONALLY SENSITIVE POINTING MICROPHONE

(75) Inventor: Anthony A. Ruffa, Hope Valley, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 08/700,573

(22) Filed: Aug. 7, 1996

(51) Int. Cl.[7] ..... H04R 25/00
(52) U.S. Cl. ..... 381/172; 381/356
(58) Field of Search ..... 381/168, 169, 381/205, 92, 355, 356, 357, 360, 361, 362, 365, 170, 172; 358/906, 909; 359/149, 150, 159

(56) References Cited

U.S. PATENT DOCUMENTS

| | | | | |
|---|---|---|---|---|
| 3,095,484 A | * | 6/1963 | Beaverson et al. | |
| 3,444,955 A | * | 5/1969 | Hoffmann | |
| 5,189,520 A | * | 2/1993 | Okayasu et al. | 358/906 |
| 5,303,304 A | * | 4/1994 | Lee | 381/169 |
| 5,504,584 A | * | 4/1996 | Soeda | 358/906 |

* cited by examiner

*Primary Examiner*—Huyen Le
(74) *Attorney, Agent, or Firm*—Michael J. McGowan; Michael F. Oglo; James M. Kasischke

(57) ABSTRACT

A microphone apparatus which includes a directional microphone having an axis of sensitivity along which the directional microphone is sensitive to sound. A light source is mechanically coupled to the directional microphone to produce a beam of light in a direction substantially commensurate with the axis of sensitivity as a visual indication thereof.

14 Claims, 1 Drawing Sheet

DIRECTIONALLY SENSITIVE POINTING MICROPHONE

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The present invention relates generally to directional microphones, and more particularly to a directional microphone apparatus equipped to illuminate a remotely located speaker or other sound source as an indication of the microphone's direction of sensitivity.

(2) Description of the Prior Art

The question and answer period during and following lectures often creates confusion and delays in a lecture program. For example, when someone in the audience wants to comment or ask a question, that person must either shout to be heard or wait for a microphone to be brought to them. In addition, when several audience members seated in the same general area wish to be heard, there is generally confusion as to which audience member is being recognized by the lecturer.

SUMMARY OF THE INVENTION

Accordingly, it is an object of the present invention to provide a microphone apparatus that is directionally sensitive to remotely located sound sources while simultaneously providing a visual indication of the direction of sensitivity of the microphone apparatus.

Another object of the present invention is to provide a hand-held directionally sensitive microphone apparatus equipped to illuminate a remotely located speaker as an indication that the microphone apparatus is active and sensitive to sounds made by the remotely located speaker.

Other objects and advantages of the present invention will become more obvious hereinafter in the specification and drawings.

In accordance with the present invention, a microphone apparatus has a hollow cylindrical tube with a microphone mounted therein to form a directional microphone having an axis of sensitivity. The directional microphone is most sensitive to sound produced along this axis of sensitivity. The microphone receives sound directed thereto by the hollow cylindrical tube from a source of sound located on or near the axis of sensitivity and remotely located with respect to the directional microphone. A light source is mechanically coupled to the hollow cylindrical tube to produce and direct a beam of light to impinge upon the source of sound. Both the light beam and microphone are activated simultaneously to give a visual indication that the microphone is active and a visual indication of the direction of the axis of sensitivity of the directional microphone.

BRIEF DESCRIPTION OF THE DRAWING(S)

Other objects, features and advantages of the present invention will become apparent upon reference to the following description of the preferred embodiments and to the drawings, wherein.

DESCRIPTION OF THE PREFERRED EMBODIMENT(S)

Figure 1:
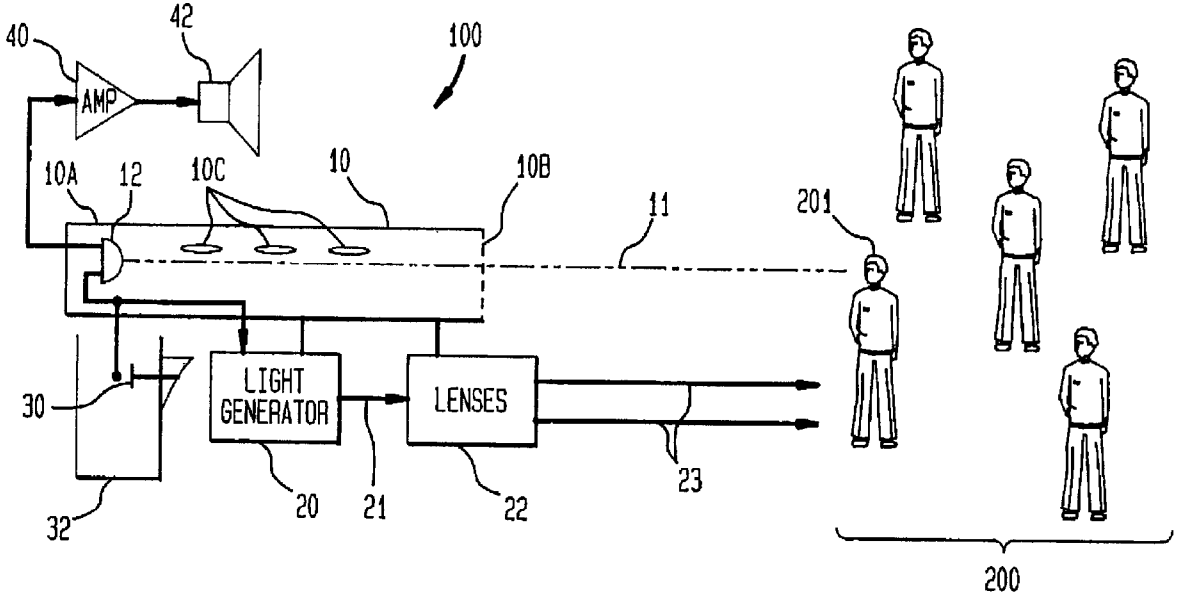
FIG. 1 is a schematic illustration of the directionally sensitive pointing microphone apparatus according to the present invention.

Referring now to the drawings, and more particularly to FIG. 1, one embodiment of the microphone apparatus of the present invention is shown and is referenced generally by the numeral 100. Microphone apparatus 100 includes a hollow cylindrical tube 10 with microphone 12 mounted therein. Tube 10 and microphone 12 form a directionally sensitive microphone having an axis of sensitivity defined by dashed line 11. Tube 10 with microphone 12 can be any one of the designs for directional microphones which are well-known in the prior art, such as those described in U.S. Pat. Nos. 3,095,484 and 3,444,955. In general, these designs form an acoustic horn from hollow cylindrical tube 10 such that it has closed end 10A (housing microphone 12) and open end 10B. Tube 10 generally includes a plurality of holes or slots 10C which help define a plurality of different length acoustic paths to microphone 12 as described fully in the aforementioned patents.

Figure 3:
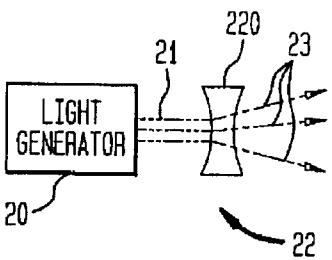
FIG. 3 is a schematic view of a second lens arrangement.
Figure 2:
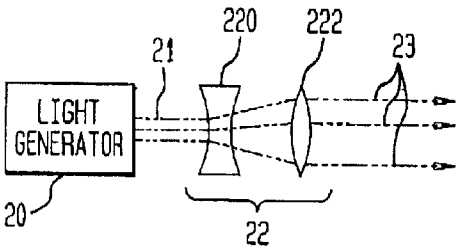
FIG. 2 is a schematic view of a first lens arrangement used to produce the light beam in accordance with the present invention.

Light generator 20 and lens 22 are attached to tube 10. Attachment to tube 10 can be a fixed attachment or movable attachment that would allow for position adjustment of light generator 20 and/or lens 22. Light generator 20 is any conventional light source, e.g., a low-power laser, capable of serving as a source of visible, eye-safe light which is represented in FIG. 1 by arrow 21. Light 21 from light generator 20 can be used directly, but more typically is directed to one or more lenses, represented in FIG. 1 by lens 22. By way of non-limiting examples, two lens arrangements are shown in FIGS. 2 and 3. In FIG. 2, light 21 passes through diverging lens 220 and then through converging lens 222. Diverging lens 220 increases the width of the incoming light and converging lens 222 limits the diameter of outgoing light beam 23 over the desired range of operation. Converging lens 222 accomplishes this by increasing the apparent distance to the source by a desired amount. The apparent distance to the source is the distance at which light rays intersect. For some applications, both diverging and converging lenses may not be needed, e.g., when a laser source is used. In such instances, a diverging lens may be sufficient as shown in FIG. 3 wherein only diverging lens 220 is used to increase the diameter of light 21 to form light beam 23 and control the apparent distance to the source. Note that for non-linear light sources, it may be sufficient to just use a converging lens.

Although the requirements of light beam 23 will vary with the application, it is generally desirable to form light beam 23 as a relatively constant-diameter beam over the range of sensitivity of the directional microphone formed by tube 10 and microphone 12. Due to spherical spreading, the diameter of light beam 23 will tend to increase with range. This can be controlled with the lens configurations as discussed above so that light beam 23 is a somewhat expanding beam that must be easily visible both at the near and maximum usable range of microphone apparatus 100.

Figure 4:
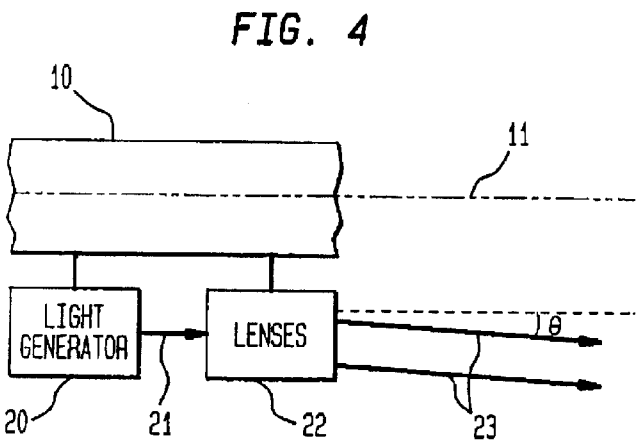
FIG. 4 is a partial illustration of the microphone apparatus of FIG. 1 showing the pointing light beam angled away from the axis of sensitivity of the apparatus' directional microphone.

Light generator 20 and lens 22 are arranged to direct light beam 23 in a direction that is aligned with axis of sensitivity 11 thereby providing a visual indication of the direction of axis of sensitivity 11. Depending on how microphone apparatus 100 is to be used, light beam 23 can be parallel to axis of sensitivity 11 as shown in FIG. 1, or angled slightly away from axis of sensitivity 11 by a small angle θ as shown in FIG. 4.

Microphone 12 and light generator 20 are simultaneously activated by means of a single switch 30 which can be a trigger type switch mounted on handle 32 extending down from tube 10. Microphone 12 is typically coupled to amplifier 40 which boosts the signal for reproduction by speaker 42.

By way of example, the present invention will be explained in its operation as a hand-held, directionally sensitive pointing microphone that can be used by a lecturer fielding comments/questions from an audience. However, it is to be understood that the present invention can be used in other situations without departing from the teachings of the present invention.

Referring again FIG. 1, when a lecturer (not shown) wishes to field a comment or question from an audience member 201 in audience 200, the lecturer points microphone apparatus 100 towards audience member 201. The lecturer activates switch 30 which simultaneously activates microphone 12 and light generator 20. The lecturer then manipulates microphone apparatus 100 so that light beam 23 illuminates audience member 201. Typically, light beam 23 will impinge upon audience member 201 at about their chest. Thus, light beam 23 provides an indication that audience member 201 was selected to speak and that the microphone is active and sensitive to the voice of audience member 201. This eliminates the time delay associated with bringing a microphone to an audience member 201 as well as any confusion as to which member of the audience is being recognized. In terms of using the present invention in this fashion, light generator 20 and lens 22 should produce light beam 23 having a diameter that does not exceed approximately 18 inches at the maximum usable range of the directional microphone formed by tube 10 and microphone 12. This will avoid providing any ambiguous indication as to which audience member is being recognized since this size beam can be manipulated so that it only strikes one audience member.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A microphone apparatus comprising:

a directional microphone having an axis of sensitivity along which said directional microphone is sensitive to sound; and a light source mechanically coupled to said directional microphone for producing a beam of light in a direction substantially commensurate with said axis of sensitivity.

2. The microphone apparatus as in claim 1 further comprising an activation switch coupled to said directional microphone and said light source for simultaneously activating said directional microphone and said light source.

3. The microphone apparatus as in claim 1 wherein said light source produces said beam of light parallel to said axis of sensitivity.

4. The microphone apparatus as in claim 1 wherein said light source produces said beam of light at an intensity that is safe for the human eye.

5. The microphone apparatus as in claim 1 wherein said directional microphone has a maximum usable range.

6. The microphone apparatus of claim 1 wherein said light source includes means for limiting the diameter of said beam of light at a maximum range to not more than 18 inches.

7. A microphone apparatus comprising:

a slotted cylindrical tube;

a microphone mounted in said slotted cylindrical tube, said microphone receiving sound directed thereto by said cylindrical tube from a source of sound that is remotely located with respect to said microphone and said cylindrical tube; and a light source mechanically coupled to said cylindrical tube for producing and directing a beam of light to impinge upon said source of sound.

8. The microphone apparatus as in claim 7 further comprising an activation switch coupled to said microphone and said light source for simultaneously activating said microphone and said light source.

9. The microphone apparatus as in claim 7 wherein said light source produces said beam of light at an intensity that is safe for the human eye.

10. The microphone apparatus as in claim 7 wherein the diameter of said beam of light does not exceed 18 inches when impinging on said source.

11. The microphone apparatus as in claim 7 further comprising:

an amplifier electrically coupled to said microphone; and a speaker electrically coupled to said amplifier.

12. A microphone apparatus comprising:

a hollow cylindrical tube;

a microphone mounted in said cylindrical tube, said microphone receiving sound directed thereto by said cylindrical tube from a source of sound that is remotely located with respect to said microphone and said cylindrical tube;

a light generator for producing light;

means for processing said light to produce a beam of light with a diameter of not more than 18 inches, said means for processing directing said beam of light to impinge upon said source of sound; and an activation switch coupled to said microphone and said light generator for simultaneously activating said microphone and said light generator.

13. The microphone apparatus as in claim 12 wherein said light generator is an eye-safe laser.

14. The microphone apparatus as in claim 12 further comprising:

an amplifier electrically coupled to said microphone; and a speaker electrically coupled to said amplifier.

* * * * *